US010507971B2

(12) United States Patent
Gabler

(10) Patent No.: US 10,507,971 B2
(45) Date of Patent: Dec. 17, 2019

(54) CONTAINER AND STIRRING DEVICE

(71) Applicant: Jochen Gabler, Aalen (DE)

(72) Inventor: Jochen Gabler, Aalen (DE)

(73) Assignee: Sprout IP APS, Taastrup (DK)

( * ) Notice: Subject to any disclaimer, the term of this patent is extended or adjusted under 35 U.S.C. 154(b) by 159 days.

(21) Appl. No.: 15/089,508

(22) Filed: Apr. 2, 2016

(65) Prior Publication Data

US 2016/0297604 A1 Oct. 13, 2016

(30) Foreign Application Priority Data

Apr. 9, 2015 (DE) ..... 10 2015 105 447

(51) Int. Cl.
*B65D 85/812* (2006.01)
*B65D 85/808* (2006.01)
*A47G 21/04* (2006.01)

(52) U.S. Cl.
CPC ..... *B65D 85/812* (2013.01); *A47G 21/04* (2013.01); *B65D 85/8085* (2013.01)

(58) Field of Classification Search
None
See application file for complete search history.

(56) References Cited

U.S. PATENT DOCUMENTS 2,562,456 A * 7/1951 Gunnar ..... B65D 85/812 426/80
2,805,162 A * 9/1957 Kovel ..... B65D 85/808 426/82
3,131,065 A 4/1964 Salomon
3,215,533 A * 11/1965 Rambold ..... B65D 85/812 206/0.5
3,387,978 A * 6/1968 Major ..... B65D 85/812 206/0.5
3,428,460 A 2/1969 Ely
6,851,550 B2 * 2/2005 Bishop ..... B65D 85/8085 206/0.5
2008/0171110 A1 7/2008 Stuart
2012/0148710 A1 6/2012 Rondia

FOREIGN PATENT DOCUMENTS

DE 20220950 U1 7/2004
DE 202008013007 U1 2/2009
EP 1946652 A1 7/2008
GB 2509518 A 7/2014

OTHER PUBLICATIONS

European Patent Office, Search Report EP 16 16 4104, dated Aug. 5, 2016.

* cited by examiner

*Primary Examiner* — Benjamin M Kurtz
(74) *Attorney, Agent, or Firm* — Greenberg Traurg, LLP; Chinh H. Pham; Brian J. Assessor

(57) ABSTRACT

A combined container and stirring device which can be used with and resembles the shape of known infusion bags is disclosed. The combined container and stirring device comprises a body made of material that is resistant to liquids. The body comprises a lower body and an upper body. A filter bag surrounding a granular, powdered, or liquid product is provided. The filter bag is arranged within a cavity in the lower body. The upper body wraps around the lower body to form a compact shape when the device is in a folded state. The upper body extends upwardly from the lower body to form a handle when the device is in an expanded state.

19 Claims, 6 Drawing Sheets

CONTAINER AND STIRRING DEVICE

TECHNICAL FIELD

The disclosure relates to a container and stirring device, and more particularly to a container and stirring device for a granular, powder, or fluid product which is surrounded by a bag-like filter. The granular, powder, or fluid product surrounded by a bag-like filter may e.g. be a tea bag or a coffee bag.

BACKGROUND

Infusion bags for holding an infusing product in a fluid, generally water, such as tea, coffee powder, cocoa powder, soup, broth or the like, are generally known. After a certain exposure time, the liquid is to be stirred, for which purpose a spoon or a similar part is generally used.

From U.S. Pat. No. 3,131,065, a tea bag is known which is provided with an aluminum flap which can be wrapped around a spoon, so that the tea bag may be stirred in the liquid together with the lower part of the spoon. A disadvantage, however, is that for stirring, a separate part, namely a spoon, must be present.

From DE 20 2008 013 007 U1, an infusion bag is known, wherein this has an elongated shape and is designed in a stable form so that stirring with the infusion bags is possible. This configuration does not require a separate stirrer, but the previously known infusion bag differs considerably from the one of the conventional form, and secondly, it requires more space in storage.

SUMMARY

An object of the present disclosure is to provide a combined container and stirring device which can be used with and resembles the shape of known infusion bags, e.g. tea bags, when in a folded state. The disclosed device eliminates the needs for a separate stirring device when in an expanded state while in use.

The combined container and stirring device comprises a body made of material that is resistant to liquids. The body comprises a lower body and an upper body. A filter bag surrounding a granular, powdered, or liquid product is provided. The filter bag is arranged within a cavity in the lower body. The upper body wraps around the lower body to form a compact shape when the device is in a folded state. The upper body extends upwardly from the lower body to form a handle when the device is in an expanded state.

Preferably, the lower body is formed by folding a first lower body section onto a second lower body section along a bottom folding edge. The first lower body section is connected to the second lower body section at a bottom section. The bottom section is formed within the bottom folding edge. An upper end of the second lower body section is connected to an upper end of the first lower body section. For example, the upper end of the second lower body section may be glued or welded to an upper end of the first lower body section. Alternatively, or additionally, the upper end of the second lower body section may comprise a flap which engages a slot in an upper end of the first lower body section. The bottom folding edge may be substantially oval and the bottom section of the lower body may be formed inside the substantially oval bottom folding edge.

The lower body may form a cavity between the first lower body section, the second lower body section, and the bottom section. The cavity may be outwardly accessible through two opposing cutouts, a first cutout being arranged in the first lower body section and a second cutout being arranged in the second lower body section. The filter bag may be arranged within the cavity.

Preferably, the upper body comprises a center section in between two lateral ribs. The center section and the lateral ribs may be arranged coplanar when the device is in the folded state. The lateral ribs may be folded along longitudinal handle folds when the device is in the expanded state. An upper end of the upper body may comprise a flap which engages a slot at an upper end of the lower body when the device is in the folded state.

A combined container and stirring device may thus comprise a lower body and an upper body. The lower body may comprises a cavity formed between a first lower body section, a bottom section, and a second lower body section. The bottom section may be arranged within a bottom fold between the first lower body section and the second lower bottom section. An upper end of the first lower body section may be connected to an upper end of the second lower body section. The upper body may wrap around the lower body to form a compact shape when the device is in a folded state and extends upwardly from the lower body to form a handle when the device is in an expanded state.

The upper body may comprise a center section in between two lateral ribs. The center section and the lateral ribs may be arranged coplanar when the device is in the folded state. The lateral ribs may be folded along longitudinal handle folds when the device is in the expanded state. The upper body may have two lateral storage folds which are arranged proximal to and outwardly of the bottom fold when the device is in the folded state.

The device may contain a filter bag surrounding a granular, powdered, or liquid product. The filter bag may be arranged within the cavity in the lower body. The filter bag may comprise a filter fabric mat or tea bag paper. The filter bag may be outwardly accessible in the cavity through one or more cutouts in the lower body.

When in the folded state the combined container and stirring device differs only slightly in form and size from known infusion bags. The product to be diffused is preferably located within a filter bag. The filter bag may be made of a filter fabric mat or a tea bag paper. The filter bag is surrounded by the folded-together container and stirring device, which wraps around the filter bag. The device may assume a frame-like shape.

In folded-out and expanded state, also referred to as the expanded state or configuration while in use, the container and stirring device assumes a spoon-like shape. The upper body resembles the handle of a spoon while the lower body resembles the bowl of a spoon. The upper body extends as a stem-like extension from the lower body.

The disclosed device combines a container for a bag-like filter with a handle that can be used for stirring, eliminating the needs for a separate stirrer, for example a spoon. The body of the device is designed correspondingly stable in form and resistant, at least for a certain time, to the fluid, in particular hot water as a liquid.

The stability of form and resistance may be formed, for example, by lateral ribs on the upper body of the device which can be folded out in the expanded state of the device at right angles relative to a center section of the upper body. The upper body may also be provided with a flap at its upper end which, together with a slot in the upper part of lower body, results in a capping element in the folded state.

The filter bag may be made of a fine filter fabric mat or tea bag paper. The filter bag may be inserted into a cavity in the lower body of the device. Advantageously, two opposing cutouts are provided in the lower body providing access to the filter bag when the device is in the expanded state. The cutouts are preferably covered by the upper body which wraps around the lower body when in the folded state. This prevents aromas and flavors from escaping the filter bag when in the folded state while allowing the aromas and flavors to be diffused into a surrounding liquid when the device is in use.

The filter bag made of fabric mat or the tea bag paper may be stuck in or shrink wrapped in lower body in the area of the cutout. The disclosed device may be used in a frame-like configuration so that a commercially available infusion bag (e.g. a tea bag) is inserted between two (in this case) open cutouts in the lower body of the device. The infusion bag is then held in the lower body of the device by a frame-like formation. The exchange with the surrounding liquid for the flavor and aroma substances can then take place through the at least one cutout or preferably two opposing cutouts.

The disclosed device provides significantly greater surface areas compared to the prior art in both the folded-together state (storage configuration) and in the expanded state (stirring configuration), on which content information, preparation times and, above all, advertising imprints can be applied. In this way, the disclosed container is particularly suitable for commercial purposes, such as self-service restaurants, rail and train companies or airlines, which can, in this way, reduce expenses with regard to a separate spoon or stirrer bar, for example, made of wood or plastic, but also have the option for advertising purposes at the same time. Other advantages include space and weight savings.

A further advantage of the disclosed device is an improved environmental performance versus the prior art. The device eliminates the need for a plastic spoon and/or wooden stirring rod. The device may be made of a biodegradable product, e.g., stably formed cardboard, biodegradable plastic, or waterproof paper and thus present no environmental impact.

DETAILED DESCRIPTION

Figure 1:
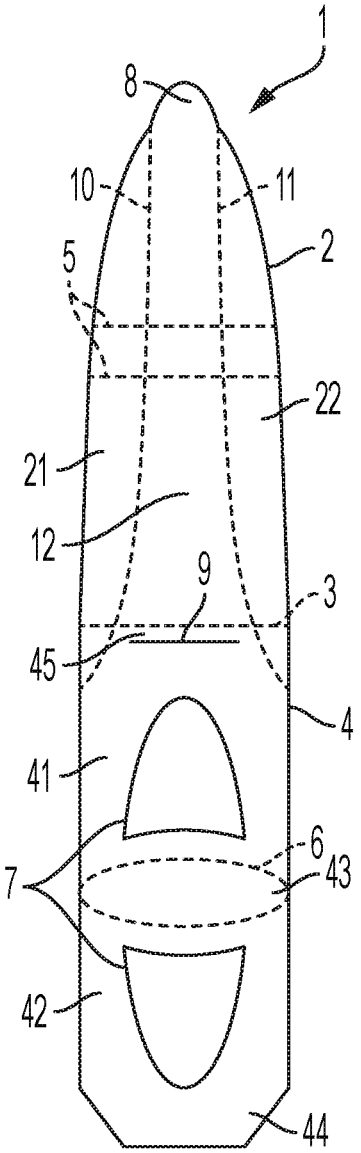
FIG. 1 shows the body of an exemplary combined container and stirring device in a pre-assembled state.

Referring to FIG. 1, the body 1 of an exemplary combined container and stirring device is shown in a pre-assembled state. The body 1 is shaped as a flat elongated strip and may e.g. be made of waterproof cardboard, paper or plastic. The body 1 comprises an upper body 2 and a lower body 4 which are connected by a pre-creased body fold 3. Two pre-creased storage folds 5 or stamped edges for folding together of the upper body 2 are arranged longitudinally spaced proximal and parallel to each other. The distance between the pre-creased storage folds 5 is at least the height of the oval bottom section 43. The pre-creased storage folds 5 extend transversely to the longitudinal axis of the strip 1.

Within the lower body 4 of the device an oval-shaped pre-creased bottom fold 6 is arranged. The pre-creased bottom fold 6 separates a first lower body section 41 from a second lower body section 42. Within the pre-creased bottom fold 6 a bottom section 43 is formed. The lower body 4 of the device is provided with two cutouts 7, which are formed opposing each other.

Figure 2:
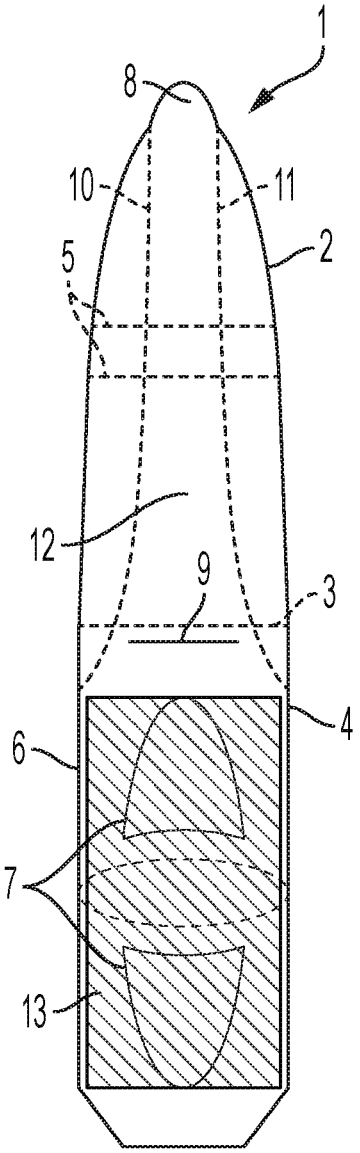
FIG. 2 shows the device as in FIG. 1 with inserted filter fabric mat or tea bag paper.

As shown in FIG. 2, a flat filter member 13 may be attached to the lower body 4. The filter member 13 may e.g. be made of fabric mat or tea bag paper. The filter member 13 extends over the cutouts 7 in the lower body 4. When assembled, the filter member 13 within the lower body 4 forms a sealed filter bag 17. The filter member 13 may e.g. be glued or welded to the lower body 4. A granular, powdered or liquid product may be introduced in the lower body 4 with the opened-out filter fabric mat. A "liquid" product within the context of the present disclosure applies to viscous and pasty products.

Figure 3:
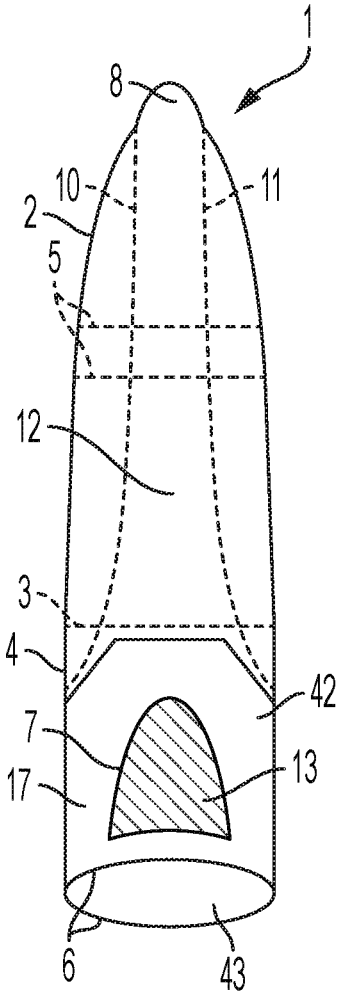
FIG. 3 shows the device as in FIG. 1 in a partially folded state.

Subsequently, as shown in FIG. 3, the lower body 4 is folded at the oval-shaped pre-creased fold 6 so as to close the lower body 4 with the filter fabric mat 13 to form a kind of tea bag as a filter bag 17. The upper end 44 of the second lower body section 42 is now arranged next to the upper end 45 of the first lower body section and preferably firmly connected thereto, e.g. by gluing.

Figure 4:
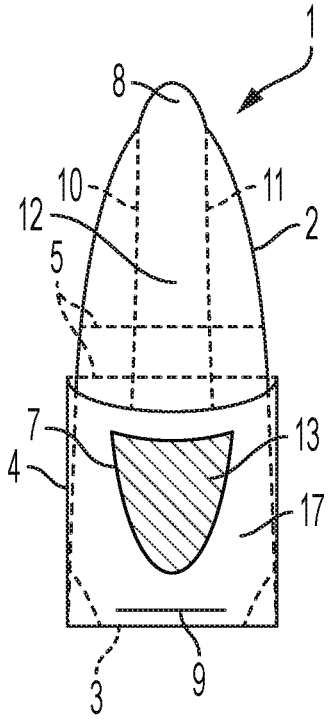
FIG. 4 shows the device as in FIG. 1 in a second partially folded state.
Figure 5:
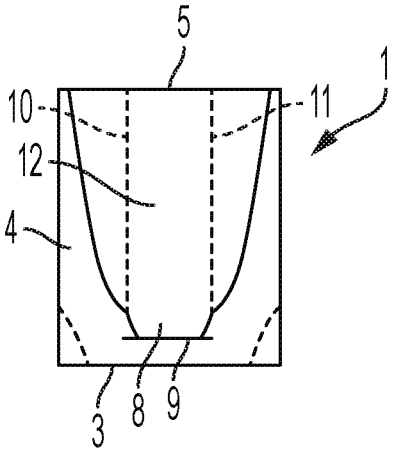
FIG. 5 shows the device as in FIG. 1 folded together in its folded state.

In a further operation, as shown in FIG. 4, the upper body 2 is retracted at the pre-creased stamped edge or body fold 3. Finally, the two storage folds 5 of the upper body 2 are relocated so that the upper body 5 wraps around the lower body 4 and covers the filter bag 17 in a protective and framing manner. For connecting the upper body 2 to the lower body 4, the upper body 2 is provided with a flap 8 on its upper end, which can be inserted into a transverse slot 9 in the lower body 4 (see FIG. 5).

Figure 6:
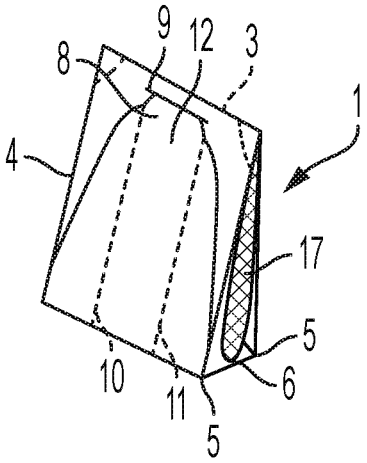
FIG. 6 is a perspective view of the device as in FIG. 5.

FIG. 6 shows the device in its fully folded-together state in a perspective view. As can be seen, this general shape of device 1 corresponds approximately to the configuration of a conventional infusion bag, e.g., a conventional tea bag. In this way, space-saving and perpendicular storage is possible, preventing damage to the filter part. Flavoring and aromatic substances remain fresh and cannot escape.

A drink is made by unfolding the upper body 2. The first and second lower body sections 41, 42 remain however folded onto each other. When the device 1 is expanded, lateral ribs 21, 22 are folded out by bending pre-creased handle folds 10, 11 which extend longitudinally along the lateral sides of the upper body 2. The lateral ribs 21, 22 may be bent at stamped edges or pre-creased handle folds 10, 11 until they extend approximately perpendicular to the center section 12 of the upper body 2. The center section 12 may be imprinted with content information, preparation times, or used for advertising imprints.

Figure 7:
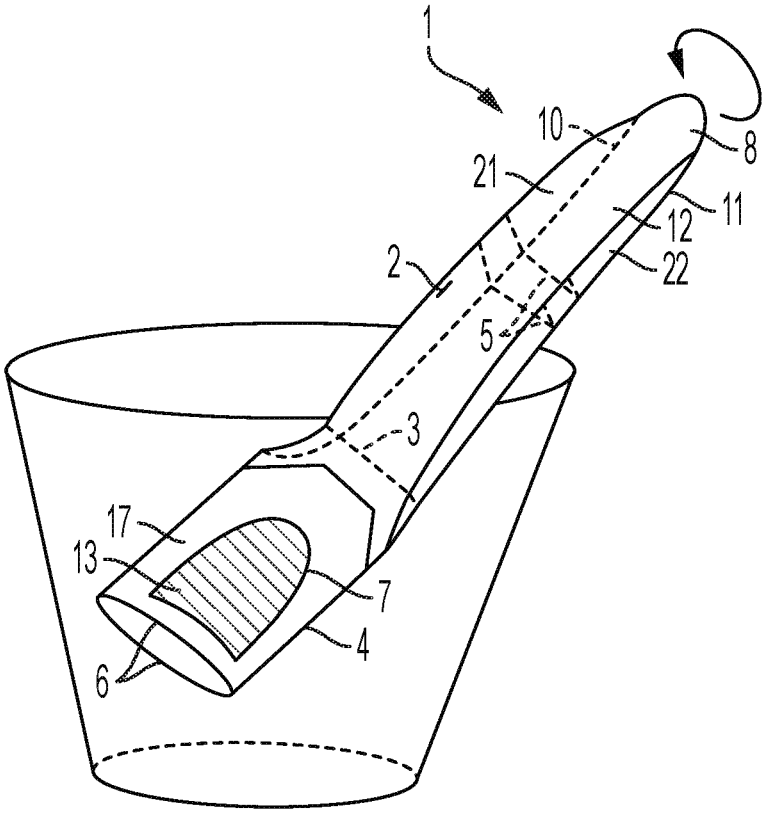
FIG. 7 shows the device as in FIG. 1 in its expanded state while in use.
Figure 8:
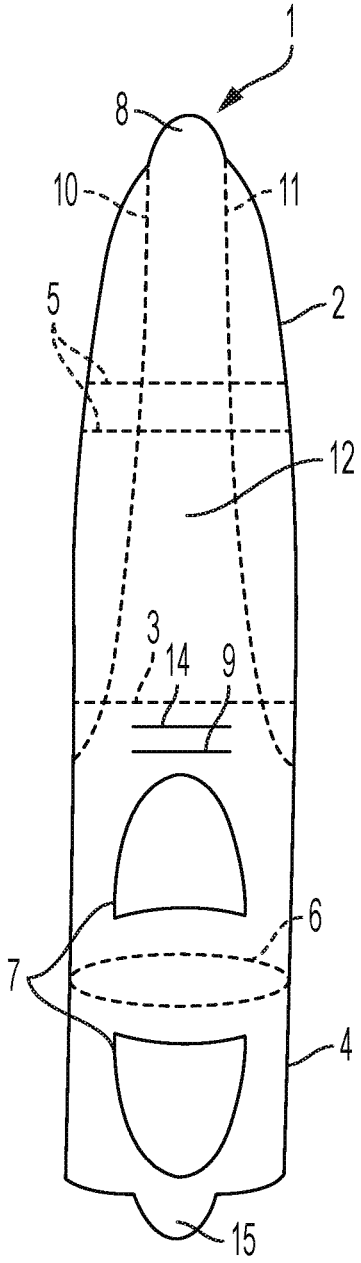
FIG. 8 shows the body of an alternative exemplary combined container and stirring device in a pre-assembled state.
Figure 9:
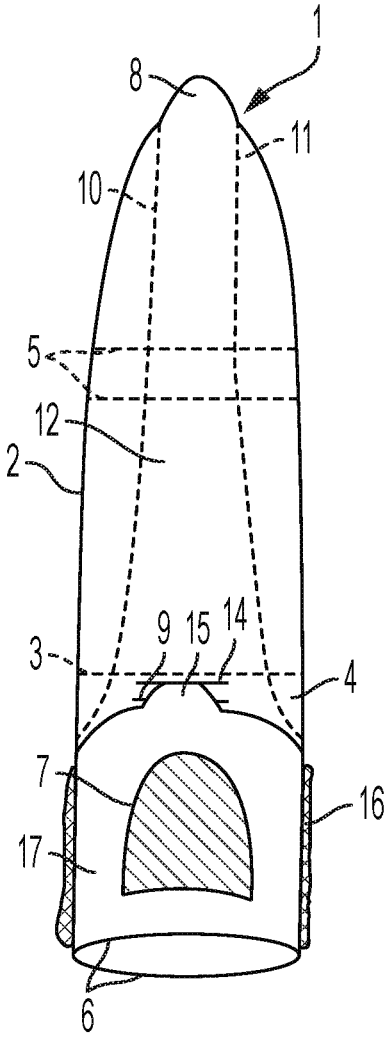
FIG. 9 shows the device as in FIG. 8 in a partially folded state.
Figure 10:
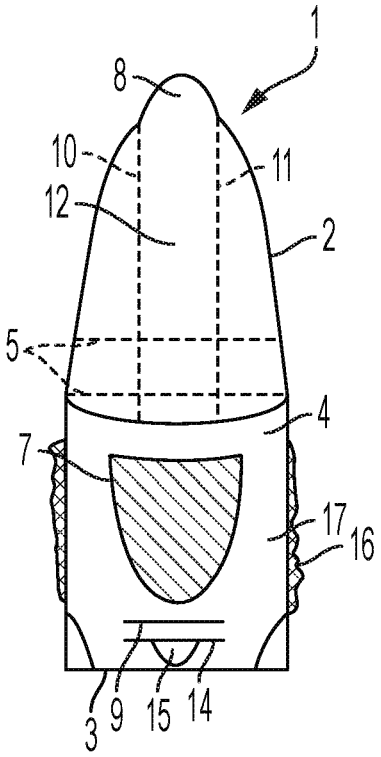
FIG. 10 shows the device as in FIG. 8 in a second partially folded state.
Figure 11:
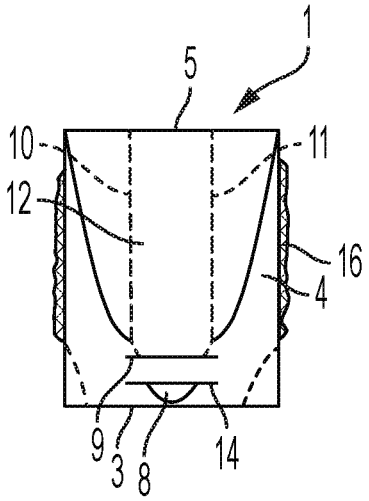
FIG. 11 shows the device as in FIG. 8 folded together in its folded state.
Figure 12:
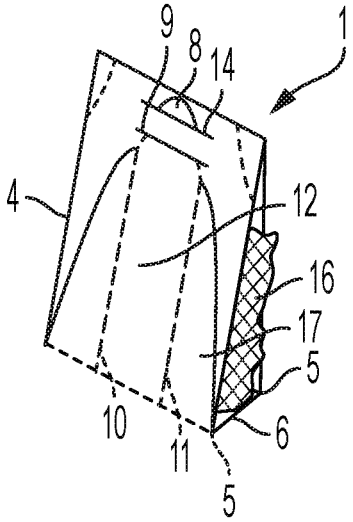
FIG. 12 is a perspective view of the device as in FIG. 11.
Figure 13:
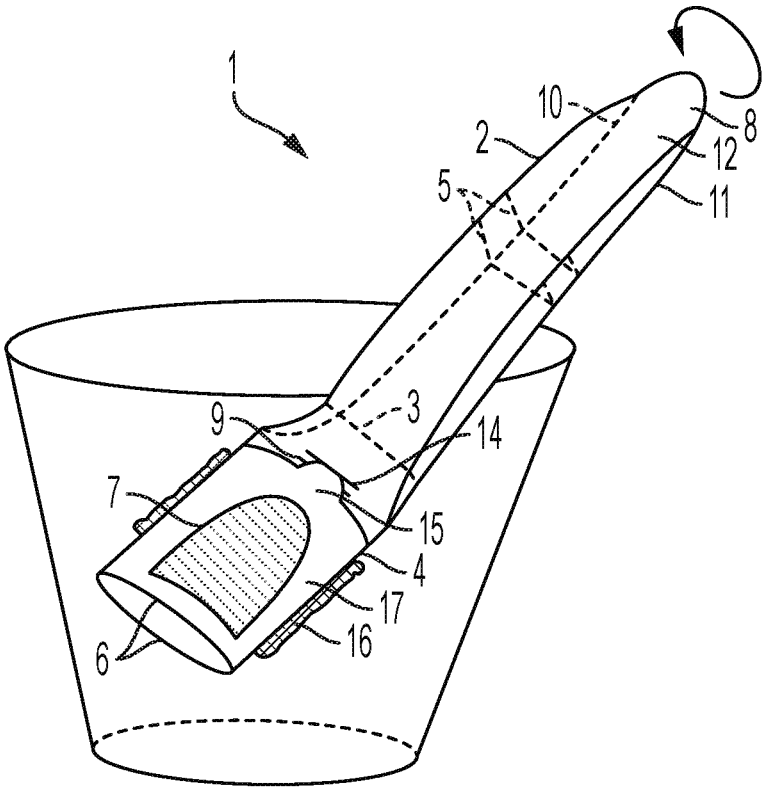
FIG. 13 shows the device as in FIG. 8 in its expanded state while in use.

As shown in FIG. 7, a stably formed and resistant construction is created by the folded out ribs 21, 22 from the center section 12 by means of the stamped handle edges 10, 11, through which the device 1 can be used as the stirrer, wherein the lower body 4 of the device 1 with the filter part 17 (the filter fabric mat/filter paper 13 or an inserted product 16) forms an agitator or a kind of spoon and the upper body 2 forms a type of handle.

An alternative container and stirring device 1 is shown in FIG. 8 through 13. The illustrated alternative device 1 is designed such that known commercially available infusion bags 16, e.g. tea bag, can be held in it. In principle, the construction is the same as the embodiment described in FIGS. 1 to 7. Comparing the FIGS. 8 and 1 or FIG. 2, however, in this case, the filter fabric mat and tea bag paper 13 over the cutouts 7 are missing. In this case, the cutouts 7 in the form of a frame-like holder are used for this, so that the taste and flavoring substances may escape from the intermediate infusion bag 16. The separate infusion bag 16 can be seen from the FIGS. 9 to 13.

In contrast to the embodiment according to FIGS. 1 to 8, however, the lower body 4 next to the slot 9 for the flap 8 has a further transverse slot 14 in the upper area of the lower body 4, in which a flap 15, which is located at the lower end of the lower body 4, can be inserted for closing of the lower body 4 (i.e., the creation of the filter part 17) and the simultaneous clamping the infusion bag 16.

The device, which is formed from the elongated strip 1 and surrounds the bag-like filter part 17 (with the filter fabric mat/tea bag paper 13 or the infusion bag 16) in a frame-like manner, may consist of an environmentally friendly and degradable material. For example, water-resistant cardboard or biodegradable plastic is suitable for this purpose, which should only be as stable or resistant so that it remains correspondingly stable for at least several minutes in the liquid in order to be able to use the stirrer.

The two embodiments have been described for the preparation of tea. The device is also suitable for other products which are prepared in the form of an infusion, e.g., soup, broth, dressing, ketchup, etc. Furthermore, the invention can also be used in camping, outdoor sports, etc. areas.

While the present invention has been described with reference to exemplary embodiments, it will be readily apparent to those skilled in the art that the invention is not limited to the disclosed or illustrated embodiments but, on the contrary, is intended to cover numerous other modifications, substitutions, variations and broad equivalent arrangements that are included within the spirit and scope of the following claims.

What is claimed is:

1. A combined container and stirring device, the device comprising:

a lower body having a cavity formed between a first lower body section, a bottom section, and a second lower body section, when folded, accommodating a filter part within the cavity, and a cutout in at least one of the first lower body section and the second lower body section exposing the filter part;

the bottom section being arranged within a bottom fold between the first lower body section and the second lower body section; and an upper body integral to and extending from the first lower body section at a body fold and designed so that (i) when folded, it is substantially flat in shape wrapping around the first lower body, section, the bottom section, and the second lower body section to form a compact shape, and (ii) when unfolded from the lower body, employing folded ribs along the upper body to provide a stable handle to be used as a stirrer.

2. The device as in claim 1, wherein the upper body comprises two lateral storage folds which are arranged proximal to and outwardly of the bottom fold when the upper body is folded.

3. The device as in claim 1, wherein the filter part surrounds a granular, powdered, or liquid product arranged within the cavity in the lower body.

4. The device as in claim 3, wherein the filter part comprises a filter fabric mat or tea bag paper.

5. The device as in claim 1, wherein the lower body comprises more than one cutout.

6. The device as in claim 5, wherein the upper body covers the more than one cutout when the when the upper body is folded.

7. The device as in claim 2, wherein the two lateral storage folds intersect two longitudinal handle folds.

8. The device as in claim 1, wherein:

the device further comprises a bottom folding edge that is substantially oval; and the bottom section of the lower body is formed inside the substantially oval bottom folding edge.

9. The device as in claim 1, wherein the cavity is outwardly accessible through two opposing cutouts, a first cutout being arranged in the first lower body section and a second cutout being arranged in the second lower body section.

10. The device as in claim 1, wherein the upper body and the lower body are made of waterproof cardboard, paper or plastic.

11. The device as in claim 1, wherein the upper body comprises a center section in between the ribs configured to make the upper body rigid when folded, for use as the stirrer.

12. The device as in claim 11, wherein the center section and the ribs are arranged coplanar when the upper body is folded and wherein the ribs are folded along longitudinal handle folds when the upper body is unfolded.

13. The device as in claim 10, wherein the upper body and the lower body are constructed from a same material.

14. A combined container and stirring device, the device comprising:

a lower body having a first lower body section and a second lower body section, the second lower body section being attached around its edge against the first lower body section and at least one of the first lower body section and the second lower body section having a cutout exposing a filter part; and a foldable upper body connected to the first lower body and designed so that (i) the upper body is substantially flat in shape to fold over and wrap around the lower body to form a secure compact shape to protect the lower body and (ii) when unfolded from the lower body, the upper body employs folded ribs along the upper body to form a stable handle to permit the device to be used as a stirrer.

15. The device as in claim 14, wherein the cutout is in the second lower body section.

16. The device as in claim 14, wherein the upper body is secured against the first lower body section when folded.

17. A foldable container device comprising:

a lower body formed by a first lower body section attached to a second lower body section and having a cutout in at least one of the first lower body section and the second lower body section;

a filter part positioned within the lower body between the first lower body section and the second lower body section;

a foldable upper body connected to the lower body and designed so that (i) when folded, the upper body is substantially flat in shape, wrapping around lower body, and is secured against one of the lower body sections and (ii) when unfolded from the lower body, the upper body employs folded ribs along the upper body to provide a stable handle that permits the lower body to be stirred in fluid.

18. The device as in claim 17, wherein the cutout is in the second lower body section.

19. The device as in claim 17, wherein the upper body is secured against the first lower body section when folded.

* * * * *